United States Patent [19]

Murakami et al.

[11] 4,152,096

[45] May 1, 1979

[54] PUMP HAVING SEAL MEANS AND PROTECTIVE MEANS

[75] Inventors: Yoshio Murakami, Tanashi; Takezo Nakazawa, Higashi, both of Japan

[73] Assignees: Mitsui Mining & Smelting Co., Ltd.; Mitsui Kinzoku Engineering Service Co., Ltd., both of Tokyo, Japan

[21] Appl. No.: 845,962

[22] Filed: Oct. 27, 1977

Related U.S. Application Data

[62] Division of Ser. No. 641,525, Dec. 17, 1975, Pat. No. 4,099,890.

[30] Foreign Application Priority Data

| | | | |
|---|---|---|---|
| Aug. 21, 1975 | [JP] | Japan | 50-115143 |
| Sep. 30, 1975 | [JP] | Japan | 50-133444 |
| Sep. 30, 1975 | [JP] | Japan | 50-133445 |

[51] Int. Cl.[2] ..... F04D 29/08; F04D 7/02

[52] U.S. Cl. ..... 415/170 A; 415/197; 415/200; 277/25

[58] Field of Search ..... 415/196, 197, 200, 170 R, 415/170 A; 277/180, 25

[56] References Cited

U.S. PATENT DOCUMENTS

| | | | |
|---|---|---|---|
| 440,798 | 11/1890 | Webbe | 415/196 |
| 2,107,260 | 2/1938 | Ihara | 415/197 |
| 2,283,263 | 5/1942 | Kates | 415/197 |
| 2,347,386 | 4/1944 | Adams | 415/197 |
| 2,536,638 | 1/1951 | Greene | 415/197 |
| 2,976,809 | 3/1961 | Buschhorn et al. | 415/196 |
| 3,115,097 | 12/1963 | Zagar et al. | 415/197 |
| 3,265,002 | 8/1966 | Warman | 415/197 |

FOREIGN PATENT DOCUMENTS

| | | | |
|---|---|---|---|
| 575644 | 4/1933 | Fed. Rep. of Germany | 415/196 |
| 1314736 | 12/1962 | France | 415/197 |

*Primary Examiner*—Carlton R. Croyle
*Assistant Examiner*—Donald S. Holland

[57] ABSTRACT

An impeller type pump has a pump body consisting of a front casing and a back casing. Each of the casings comprises a ceramic main portion and a protection member covering the main portion. The protection members of both the main portions are interconnected with each other at their confronting marginal portions through a continuous packing. Those confronting marginal portions of both the main portions which are adjacent to a pump chamber defined by inner surfaces of both the main portions are provided each with a plurality of concentrical rims loosely interdigitated to form a labyrinthine narrow passage restricting the flow of waste water therebetween, resulting in reduction of wear of the packing.

2 Claims, 18 Drawing Figures

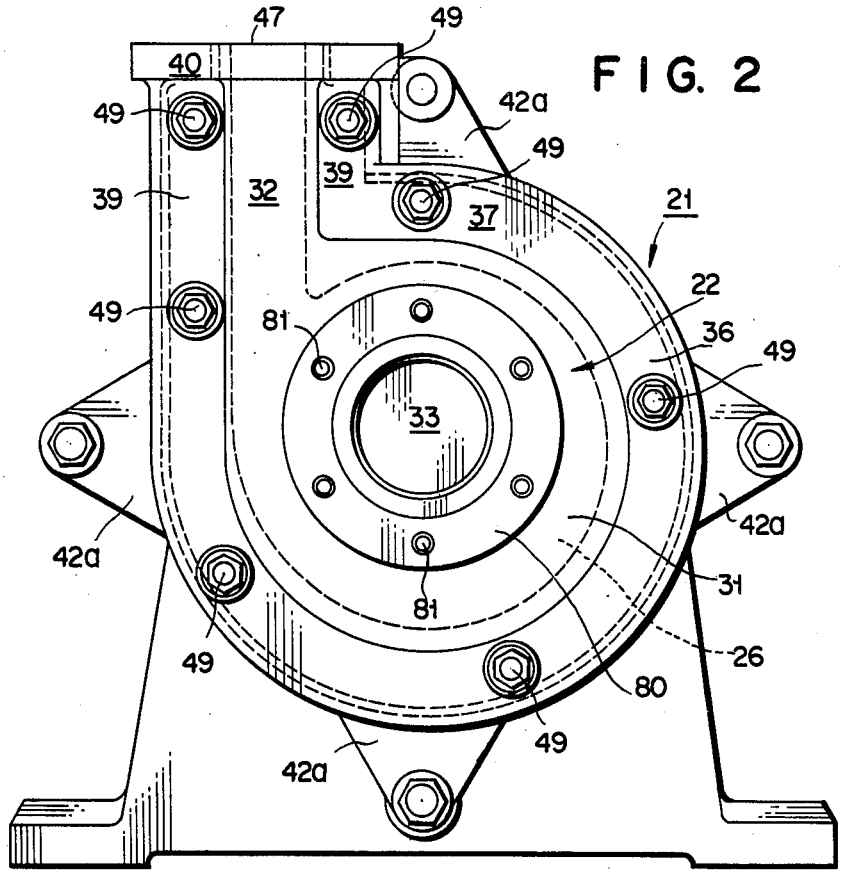
FIG. 2
FIG. 3
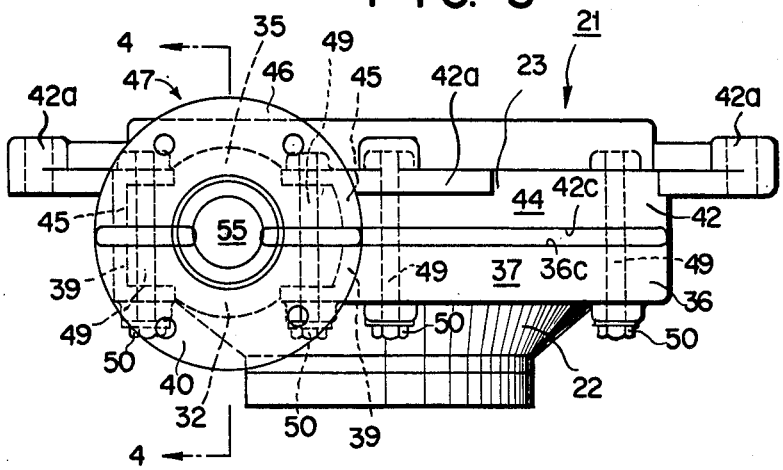

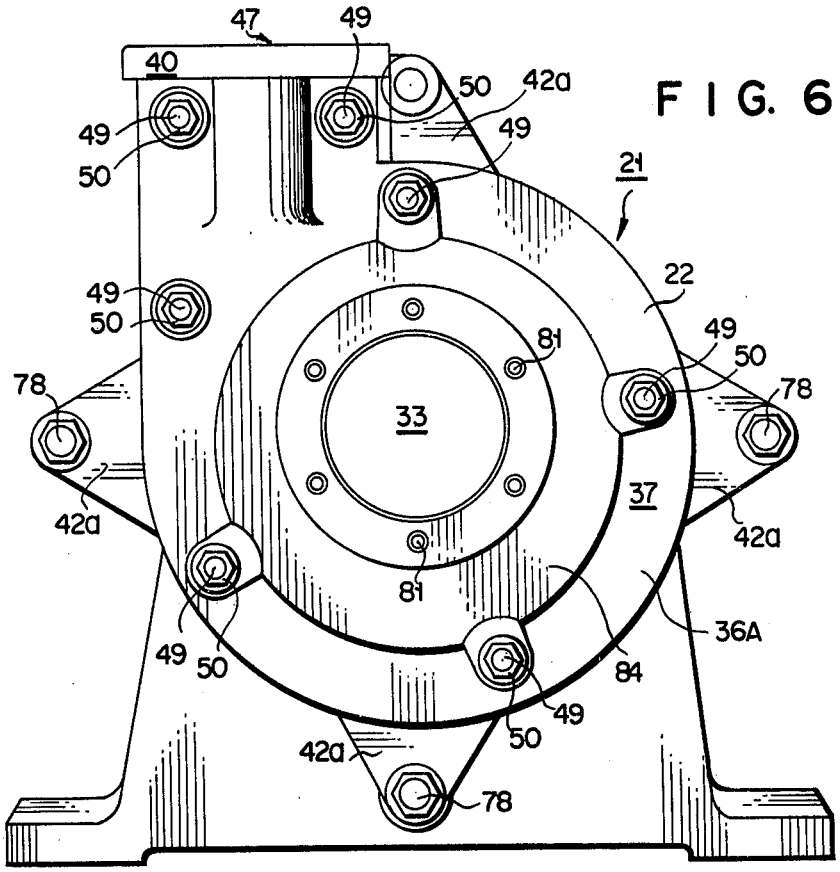
FIG. 6
FIG. 7
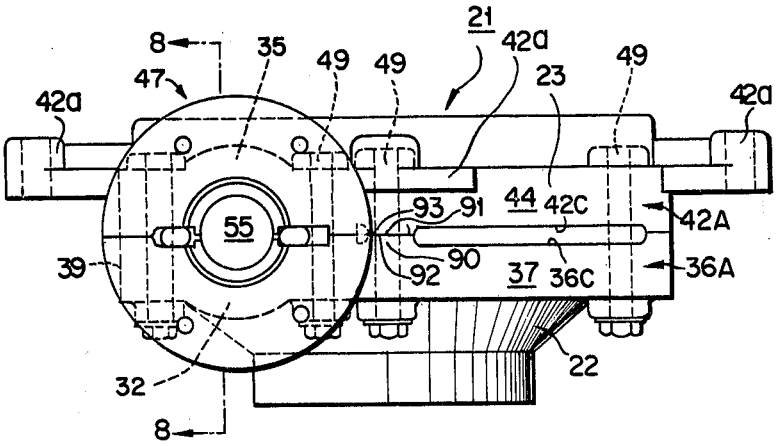

PUMP HAVING SEAL MEANS AND PROTECTIVE MEANS

This is a division of application Ser. No. 641,525, filed Dec. 17, 1975, now U.S. Pat. No. 4,099,890.

BACKGROUND OF THE INVENTION

This invention relates to a pump and in particular a pump for treating waste water including abrasive material and slurry.

DESCRIPTION OF THE PRIOR ART

As a growing demand has recently been made to treat a great amount of waste liquid such as waste water, slurry and waste chemicals so as to prevent water pollution, the treating equipment becomes larger in size and is used under severer conditions. When the waste water and slurry including earth and sand are pumped in a pump, a high wear-resistance is required for the pump body and impeller of the pump. In the case of pumping chemically reactive liquid including, for example, an alkaline solution, a high corrosion-resistant property is necessary for the pump body and the impeller and in a case of a hot waste water treatment a high heat-resistance is necessary for them. Since, in the conventional pump, the pump body and impeller are made of cast iron, they are low in wear- and corrosion-resistance with respect to such waste liquid failing to treat the waste liquid.

In order to overcome such drawbacks a liner, such as rubber, showing a wear- and corrosion-resistant property is attached to the inner wall of the pump body which is exposed to the waste water as well as to the outer surface of a cast iron impeller. However, the pump body has a complicate inner surface and many cumbersome steps are required to line the inner surface of the pump body with a liner. Furthermore, such a liner has no sufficient wear- and corrosion-resistance with respect to the waste liquid.

SUMMARY OF THE INVENTION

An object of this invention is to provide an impeller type pump having ceramic main portions of a pump body provided with narrowed portions for reducing the circumferential speed of waste water therebetween more than the circumferential speed of waste water in a pump chamber in the pump body so that the wear of a continuous packing between protection members covering the respective ceramic main portions due to abrasive material in the waste water is reduced to a minimum, and that part of solid material in the waste water is separated and deposited on the exposed surface of the packing to prevent further wear of the packing.

According to this invention there is provided a pump comprising a pump body, a pump chamber defined within the pump body, an intake port and a discharge port each provided in the pump body so as to communicate with the pump chamber, an impeller disposed within the pump chamber, said pump body comprising a front casing including one part of the pump chamber, a half portion of the discharge port and the intake port and having a first main portion made of ceramic material and a back casing including the other part of the pump chamber and the other half portion of the discharge port and having a second main portion made of ceramic material, said front and back casings being connected at their marginal portions to each other through a packing and said impeller being made of ceramic material.

In order to prevent breakage of the front casing due to external shocks and stresses, a metallic protection member may be mounted on the outer surface of the front casing. Another metallic protection member may be mounted on the outer surface of the back casing and the pump body be mounted on the pump bed by means of the metallic protection member. In consequence, the pump body can be easily and accurately mounted on the pump bed and the back casing is prevented from being broken due to external shocks and stresses.

The protection members can be attached to the outer surface of the front and back casings by, for example, plastic adhesive layer. In this case, an effective protection can be afforded to the front and back casings.

The confronting marginal portions of the front and back casings which are close to the pump chamber are formed in a rim-like or labyrinthine structure so as to reduce the wear of a packing between the front and back casings.

A metallic connector may be fitted into the center shaft of the impeller and the forward end of the drive shaft be inserted into the metallic connector, thereby reducing external shocks and stresses exerted by the drive shaft on the impeller.

The connector may be provided with a female screw which is fitted into the center shaft of the impeller and is engaged with a male thread on the forward end portion of the drive shaft. The connector may have an externally threaded forward end portion which extends through the impeller, and a cap nut be tightened over the externally threaded forward end portion of the connector.

Preferably, slits may be circumferentially equidistantly provided over a length of the connector with an unslitted portion left at the rear end portion of the connector, so that thermal expansion of the connector can be absorbed.

BRIEF DESCRIPTION OF THE DRAWINGS

This invention can be more fully understood from the following detailed description when taken in conjunction with the accompanying drawings, in which:

FIG. 2 is a front view of FIG. 1;

FIG. 3 is a plan view of FIG. 1;

FIG. 6 is a front view of FIG. 5;

FIG. 7 is a plan view of FIG. 5;

DESCRIPTION OF THE PREFERRED EMBODIMENTS

Figure 1:
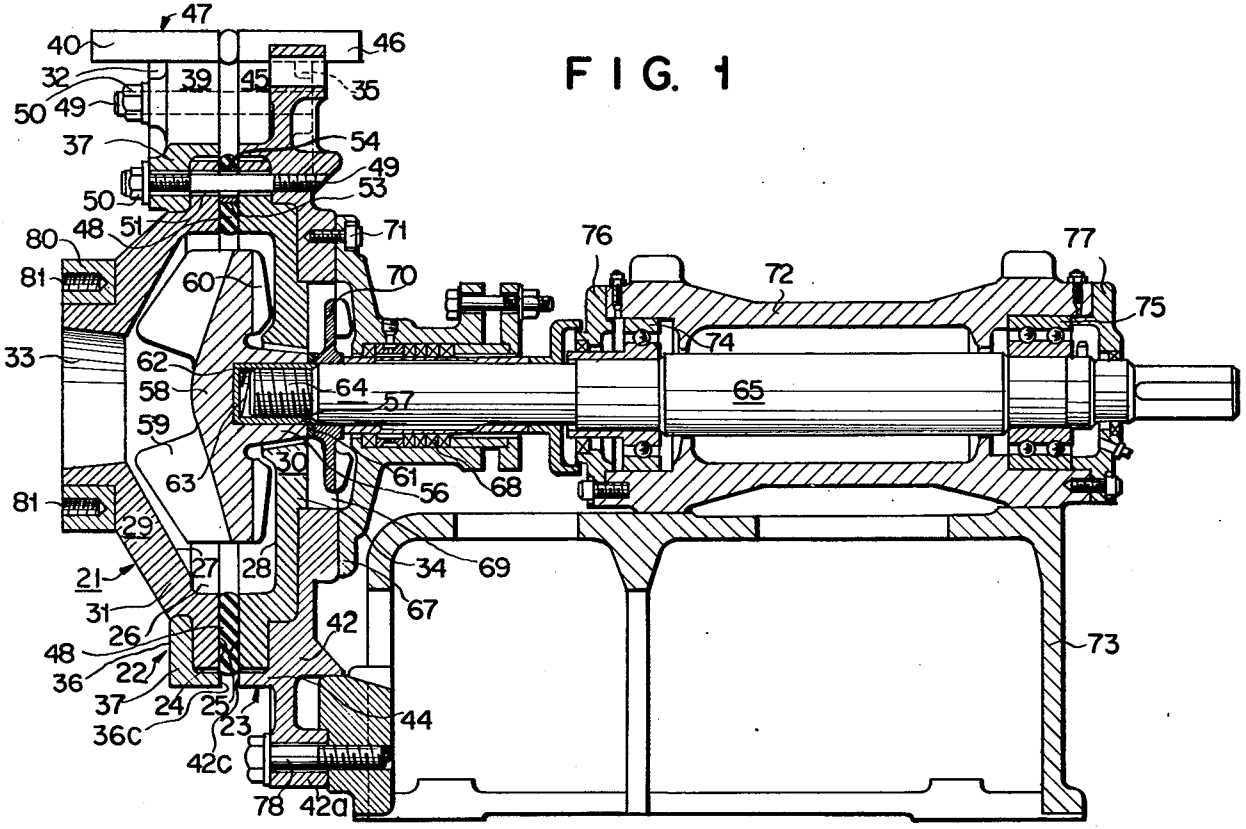
FIG. 1 is a longitudinal cross-sectional view showing a pump according to one embodiment of this invention.
Figure 4:
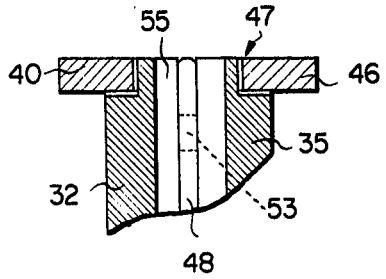
FIG. 4 is a partial, cross-sectional view as taken along line 4—4 in FIG. 3.

Like reference numerals are employed to designate like parts or elements throughout the drawings.

In FIGS. 1 to 4, a pump body 21 comprises a combination of a front casing 22 and back casing 23. A pump chamber 26 is defined, by recessed internal surfaces 27 and 28 of the casings 22 and 23 respectively, in the pump body 21. Main portions 29 and 30 of the pump body 21 including the recessed internal surfaces 27 and 28 of the casings 22 and 23 are made of a ceramic material, such as a silicon carbide refractory material etc. including silicon nitride and silicate as a bond, which is resistant to wear, corrosion and a high temperature. The main portion 29 of the front casing 22 includes a substantially funnel-like portion 31 and an upright portion 32, which has an Ω shaped cross section (FIG. 3) and tangentially extends from funnel-like portion 31 (FIG. 2). An inlet port 33 extends through the central portion of the funnel-like portion 31 so as to communicate with the interior of the pump chamber 26. The main portion 30 of the back casing 23 includes a substantially tray-like portion 34 and an upright portion 35, which has an Ω shaped cross section (FIG. 3), which tangentially extends from the tray-like portion 34.

A first protection member 36 comprises a flange member 37 covering a maximum outer diameter area of the funnel-like portion 31 of the main portion 29 and a pair of upright portions 39, which have a substantially L-shaped cross section and extends from the flange member 37. A second protection member 42 comprises a tray-like portion 44 covering the outer marginal portion and outer periphery of the main portion 30 and a pair of upright portions 45, which have a substantially L-shaped cross section, and extend from the flange member 37. On the top surface of the upright portions 39 and 45 is formed a flange 47, consisting of semicircular flange halves 40, 46, to which an outlet pipe fitting (not shown) is fixed. The first and second protection members 36, 42 are bonded by adhesive, respectively, to the main portions 29 and 30 of the front and back casings 22 and 23 so as to partially cover the main portions 29 and 30. This prevents external shocks and stresses from being applied to the main portions 29 and 30 of the front and back casings 22 and 23. Confronting marginal portions 24 and 25 of the main portions 29 and 30, respectively, extend, on one hand, circumferentially of the funnel-like portion 31 and tray-like portion 34 and, on the other hand, along the upright portions 32 and 35 such that marginal portions 24, 25 define a flat plane. The pump body 21 is assembled by inserting, as will be later described, a packing 48 such as natural rubber between the confronting marginal portions 24 and 25 and securing together the front and back casings 22 and 23 by means of bolts 49 and nuts 50. That is, common bores 51, extending through the main portions 29 and 30, protection members 36 and 42 and packing 48, are provided around the outer marginal portions 24, 25 of the front and back casings 22 and 23, and the bolts 49 are inserted into the common through bore 51, and the nuts 50 are tightened on the bolts 49, causing the packing 48 to be elastically deformed to permit a liquid-tight sealing between the front and back casings 22 and 23. Bores 53 larger in diameter than the bores are provided in the packing 48 and sleeve-like spacers 54 of the same length, which is shorter than the free width of the packing 48, are inserted into the bores 53 in a manner to be pierced by the bolts 49. When the nuts 50 are tightened to cause the packing 48 to be gradually deformed, each end of the respective spacers 54 abuts against the marginal portions 24 and 25 and no further deformation of the packing 48 is effected, making always constant a distance between the marginal portions 24 and 25 with the result that the pump is assembled with high accuracy. By so securing together the front and back casings 22 and 23 a discharge port 55 which communicates with the pump chamber 26 (FIG. 3) is formed at the center of the assembled flange 47.

Housed in the pump chamber 26 is an impeller 58 made of the same ceramic material as that of the main portions 29 and 30 of the front and back casings 22 and 23 with the center shaft 56 of the impeller 58 loosely fitted in a bore 57 formed in the central portion of the back casing 23, as shown in FIG. 1. The impeller 58 is provided with front blades 59 at the front side and with rear blades 60 at the rear side to pressurize waste water sucked from the inlet port 33 into the pump chamber 26 as the impeller 58 rotates. A hollow cylindrical metallic connector 62 having an internally threaded portion 63 is inserted at the free end or rear end 61 into the center shaft 56 of the impeller 58 and bonded by an adhesive to the center shaft 56. The internally threaded portion 63 of the connector 62 is engaged with an externally threaded portion 64 formed on the forward end of a drive shaft 65 which is rotated by a drive means (not shown). The impeller 58 is rotated by the driving means through the drive shaft 65 and the connector 62. Since the impeller 58 of ceramic material is coupled through the elastic metal connector 62 to the drive shaft 65, shocks and stresses from the drive shaft are greatly absorbed by the connector 62, and there is less chance that the impeller will be broken. The connector 62 is made of metal which can be machined to a high accuracy. Thus, after the connector 62 is fitted in the center shaft 56 of the impeller 58, the internally threaded portion 63 is formed precisely and easily so that the center shaft 56 of the impeller 58 and the drive shaft 65 are correctly aligned with each other for the safe driving of the pump.

Referring to FIG. 1, a metallic seal box 67 through the central portion of which the forward end of the drive shaft 65 passes is fixed to the rear of the back casing 23 i.e., the rear of the pump body 21 by means of, for example, bolts 71. A seal packing 68 is disposed between the boss portion of the seal box 67 and forward end portion of the drive shaft 65 so as to make a liquid-tight seal therebetween. An auxiliary chamber 69 is defined by the recessed inner surface of the seal box 67 and the rear surface of the back casing 23. Within the auxiliary chamber 69 is housed an auxiliary impeller 70 which is secured to the forward end of the drive shaft 65. The auxiliary impeller 70 is adapted to bring back to the pump chamber 26 waste water which is leaked into the auxiliary chamber 69 through a clearance between the center shaft 56 of the impeller 58 and the central bore 57 of the main portion 30 of the back casing 23. Behind the seal box 67 is disposed a bearing box 72 which is mounted on a bed 73. The drive shaft 65 extends through the bearing box 72 and is rotatably supported by bearings 74, 75 which are provided at each end of the bearing box 72. End members 76 and 77 cover both the ends of the bearing box 72. Arms **42*a* are integrally mounted on the second protection member 42 and secured to the bed 73 by means of bolts 78 so that the pump body 21 is firmly secured to the bed 73 (see FIG. 5). In this way, the second protection member 42 acts as a mounting member. Since the second protection member 42 is made of metal, it is very easily machinable, unlike a ceramic material, with high accuracy. In this case, forming mounting holes in the desired position assures a high accurate mounting of the pump body 21 with respect to the bed 73**.

A ring-like metal flange 80 is bonded by an adhesive to the outer periphery of the inlet port 33 in the front casing 22. A plurality of threaded holes 81 permitting a pipe fitting (not shown) to be mounted on the flange 80 is circumferentially equidistantly provided at the free end of the metal flange 80. The use of the flange 80 permits the front casing 22 to be protected against external impacts and stresses being applied on the pipe fitting.

In operation, the impeller 58 and auxiliary impeller 70 are rotated by the drive shaft 65 to cause waste water to be admitted into the pump chamber 26 through the inlet port 33. The waste water is compressed within the pump chamber 26 and discharged from the discharge port 55. By the rotation of the auxiliary impeller 70 the waste water flowing into the auxiliary chamber 69 is brought back into the pump chamber 26 to cause waste water pressure acting on the seal packing 68 to be decreased, thereby preventing leakage of the waste water from the seal box 67. The rear blades 60 of the impeller 58 serve the double function of preventing a flow of the waste water into the pump chamber 26 and radially outwardly sending some waste water which is returned from the auxiliary chamber 69.

Since the main portions of the front and back casings 22 and 23 in the pump body 21 are made of a ceramic material, they have excellent wear-, corrosion- and heat-resistant properties. In consequence, the pump can be used continuously for a long time without any maintenance or repair work even when the pump is applied under the severe conditions in which it is necessary to treat waste water containing abrasive material, chemicals of strong acidity or alkalinity or hot exhaust liquid.

Figure 5:
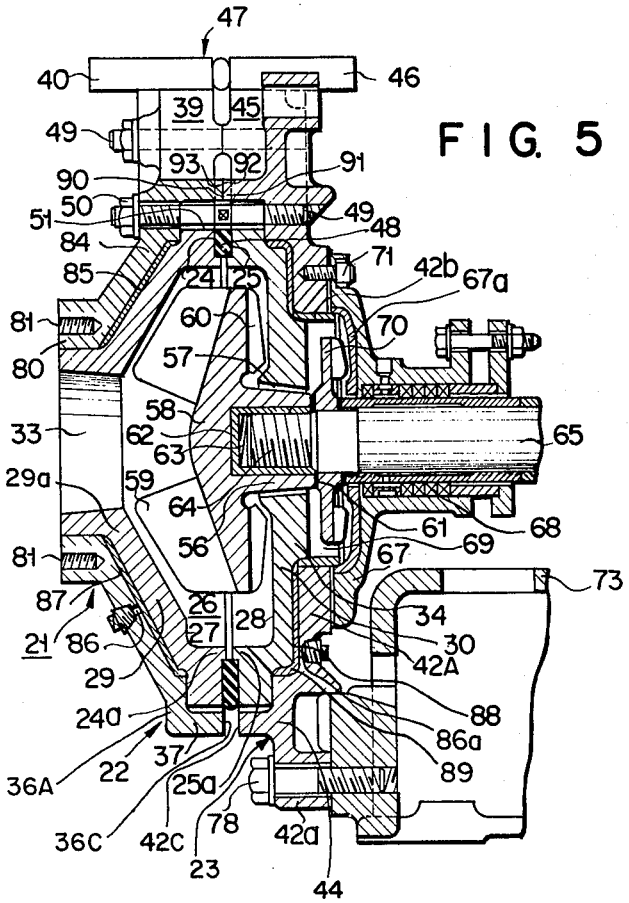
FIG. 5 is a partial, longitudinal cross-sectional view showing a pump according to another embodiment of this invention.
Figure 9:
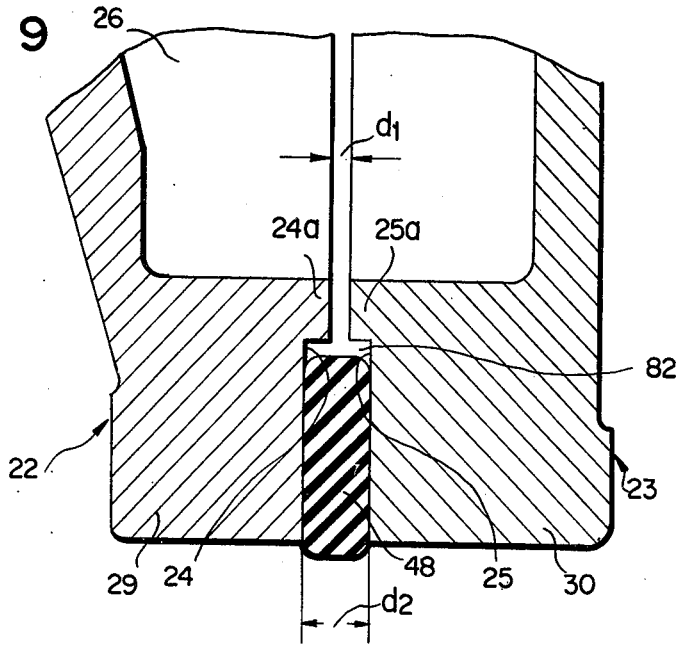
FIG. 9 is a partially enlarged cross-sectional view in which the confronting marginal portions of front and back casings are narrowed at a place close to a pump chamber in FIG. 5.

FIG. 5 shows a pump body 21 according to another embodiment of this invention. In this embodiment, the radial inner surface portions of the confronting marginal areas 24 and 25 in the main portions 29 and 30 of the front and back casings 22 and 23 form annular rims **24*a* and 25*a*, respectively, as shown in FIG. 9. A distance $d_1$ between the annular rims 24*a*, 25*a* of the confronting marginal portions 24 and 25 are made fairly narrower than a distance $d_2$ between the remaining radial inner surface portions of the confronting marginal areas 24 and 25. Even if, in this case, some waste water within the pump chamber 26 flows into a space 82 defined by part of clearance $d_2$ between the remaining radial inner surface portions of the confronting marginal areas 24 and 25, the narrowed clearance between the annular rims 24*a*, 25*a* restricts the flow of the waste water, whereby the circumferential speed of the waste water between the rims 24*a*, 25*a* is prominently reduced as compared with that of the waste water in the pump chamber 26. As a result, the wear of the packing 48 by abrasive material is reduced to a minimum and part of solid material in the waste water is separated and deposited on the exposed surface of the packing 48**, thereby preventing further wear of the packing.

Figure 10:
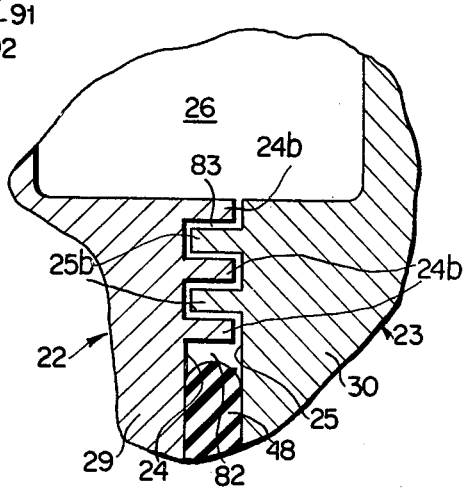
FIG. 10 is a cross-sectional view showing a modification of FIG. 9.

FIG. 10 shows part of a pump body according to another embodiment of this invention in which concentrical rims **24*b* and 25*b* are integrally formed on the portions 24*a* and 25*a* of the confronting marginal areas 24 and 25, respectively, in the main portions 29 and 30 of the front and back casings 22 and 23 to form a labyrinthine structure. A narrow labyrinthine passage 83 defined between the portions 24*a*, 25*a* restricts the flow of the waste water from the pump chamber 26 to a space 82 defined between the portions of the marginal areas 24, 25 other than the portions 24*a*, 25*a*. The waste water between the space 82 is, therefore, hardly rotated and, in consequence, the wear of the packing 48 is further reduced as compared with the embodiment shown in FIG. 9**.

Referring again to FIG. 5, the entire outer surfaces of the main portions 29 and 30 in the front and back casings 22 and 23 are covered, respectively, by first and second metallic protection members 36A and 42A made of, for instance, cast iron. Between a funnel-like portion 84 of the first protection member 36A and a funnel-like portion **29*a* of the main portion 29 is formed a clearance 85 into which, for example, a fluid filler made of synthetic resin or adhesive 87, which is solidified to bend together the funnel-like portion 84 of the first protection member 36A and funnel-like portion 29*a* of the main portion 29 and show elasticity after solidified, is poured from a hole 86 in the funnel-like portion 84 of the first protection member 36A. Likewise, a fluid filler 89 made of the same material as the filler 87 is poured from a hole 86*a* into a clearance 88 defined between the tray-like portion 34 of the main portion 30 in the back casing 23 and the tray-like portion 44 of the second protection member 42A. Consequently, when external impacts and stresses are applied to the pump body 21, they are substantially absorbed by both the protection members 36A and 42A and filling the fillers 87, 89 and there is less chance that the main portions 29 and 30 in the front and back casings 22, 23 will be broken. Even though a crack or breakage might occur at the main portions 29 and 30 in the front and back casings, the pump body 21 is protected by the first and second protection members 36A and 42A, thus preventing fluid leakage as well as spattering of fragments of the broken pump body 21 and attaining the elevated stability of the pump per se. Furthermore, since the main portions 29 and 30 are integrally bonded by the fillers 87 and 89 to the first and second protection members 36A and 42A**, respectively, the disassembly of the pump can be easily effected for repair, cleaning etc.

Protection elements **42*b* and 67*a* made of the same material of the main portions 29, 30 are fixed to that inner wall of the second protection member 42A which faces an auxiliary pump chamber 69 and the inner wall of the seal box 67 so as to prevent the wear and chemical corrosion of the second protection member 42A and seal box 67**.

Figure 8:
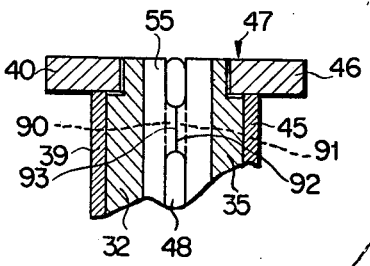
FIG. 8 is a partial, cross-sectional view as taken along line 8—8 in FIG. 7.
Figure 12:
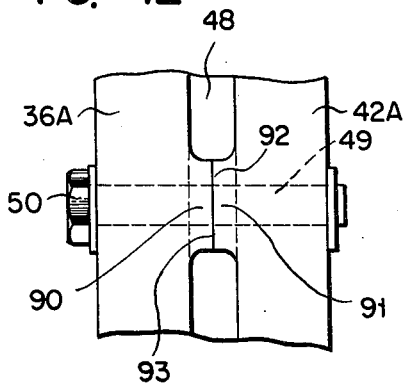
FIG. 12 is a partial side elevational view showing first and second protection members in FIG. 5.
Figure 13:
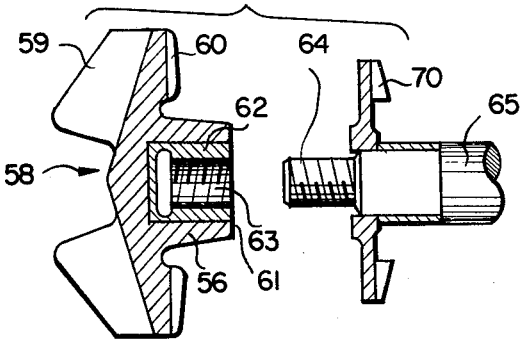
FIG. 13 is an exploded cross-sectional view of an embodiment of an impeller connector in the pump and an associated drive shaft.

In the embodiment shown in FIG. 1 the marginal surface 36c of the first protection member 36 is spaced apart from the marginal surface 42c of the second protection member 42, while, in FIG. 5, those portions of the marginal areas 24 and 25 through which bolts 49 extend include projections 90 and 91, respectively. The projections 91 are so arranged in circumferentially spaced relation with each other on the marginal surface 36c of the first protection member 36 as to extend toward the marginal surface 42c of the second protection member 42. Similarly, the projections 92 are so arranged in circumferentially spaced relation with each other on the marginal surface 42c of the second protection member 42 as to extend toward the marginal surface 36c of the first protection member 36 and to align with the respective projections 91 of the first protection member 36. Both projections 91 and 92 have flattened end surfaces 92 and 93 which are abutted against each other to maintain a constant distance between the marginal areas 24 and 25 of the first and second protection members 36, 42. Therefore, in this embodiment, the pump body 21 can be accurately assembled without using any spacers, unlike the embodiment of FIG. 1. FIGS. 8 and 12 show the manner in which the projections 90 and 91 are abutted against each other.

Figure 11:
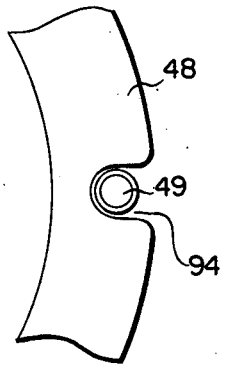
FIG. 11 is a partial plan view showing a packing used in this invention.

In the arrangement shown in FIG. 11, those portions of a packing 48 through which the bolts 49 extend include cutouts 94. When the first and second protection members 36A and 42A are bonded together with the packing 48 interposed therebetween, the cutout 94 guides the corresponding bolt 49 and allows the bolt 49 to easily pass through the packing 48. The other arrangement is similar to that shown in FIGS. 1 to 4 and any further explanation will be omitted.

Figure 14:
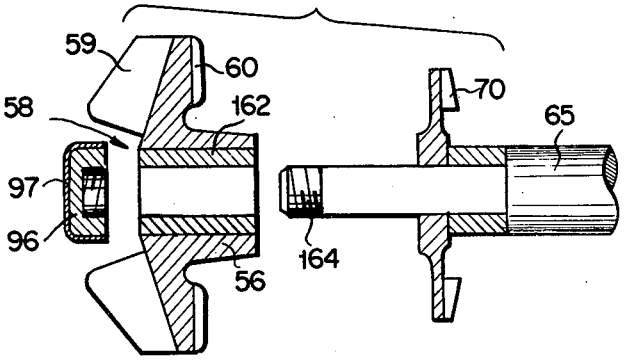
FIG. 14 is an exploded cross-sectional view of another embodiment of an impeller connector used in the pump and an associated drive shaft.

In FIG. 14 is shown another metallic connector 162 which is different from the above-mentioned metallic connector 62. The connector 162 assumes a hollow cylindrical configuration and extends through the center shaft 56 with the rear end of the connector 162 made flush with the rear end of the center shaft 56. The drive shaft 65 has an externally threaded end portion 164 and, when the drive shaft 65 is inserted into the center shaft 56 until an auxiliary impeller 70 mounted on the drive shaft 65 abuts against the rear end of the center shaft 56, the externally threaded portion 164 of the drive shaft 65 is projected from the forward end of the center shaft 56 and brought into mesh with a cap nut 96 whose outer surface is bonded with a protector 97 made of the same ceramic material as that of the impeller 58. As a result, the impeller 58 is fixed to the drive shaft 65.

Figure 15:
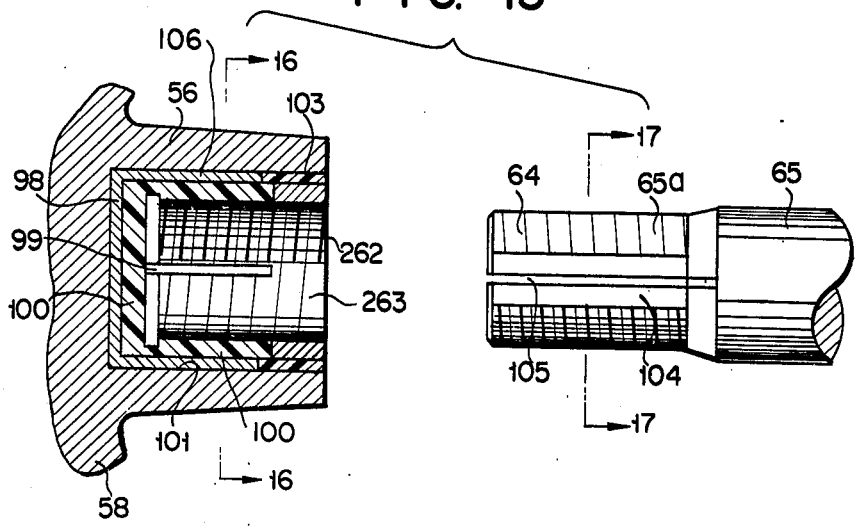
FIG. 15 is an exploded cross-sectional view of further embodiment of an impeller connector used in the pump and an associated drive shaft.
Figure 16:
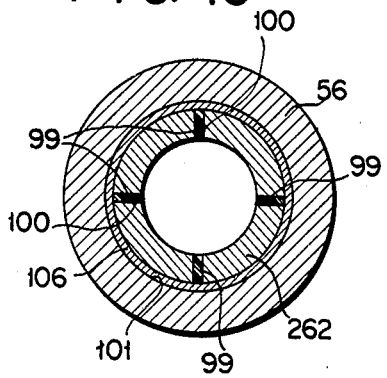
FIG. 16 is a cross-sectional view as taken along line 16—16 in FIG. 15.
Figure 17:
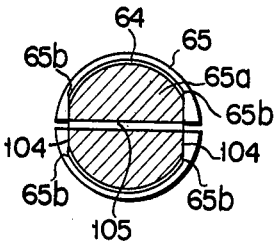
FIG. 17 is a cross-sectional view as taken along line 17—17 in FIG. 15.
Figure 18:
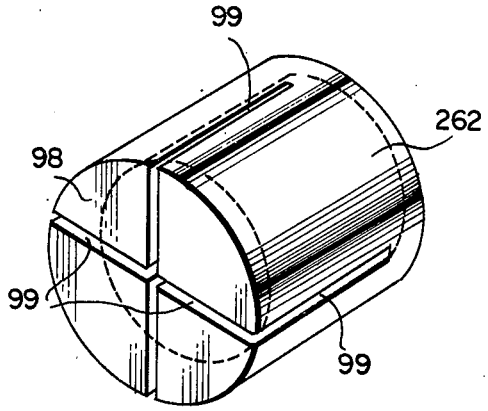
FIG. 18 is a perspective view showing the main body of the connector in FIG. 15.

FIGS. 15 to 18 show a metallic connector 262 according to another embodiment of this invention. As shown in FIGS. 15, 16 and 18, the metallic connector 262 assumes a hollow cylindrical configuration with a closed end wall 98 and has an internally threaded portion 263 at the inner surface. Longitudinal slits 99 are circumferentially equidistantly provided in the outer periphery of the metallic connector 262 in a manner to intersect at the outer surface of the closed end wall 98. The slit 99 extends over $\frac{2}{3}$ to 4/5 of the whole length of the metallic connector 262. A filled 100 such as elastic rubber or plastic material is filled in the slits 99. A closed hole 101 is bored in the center shaft 56 of the impeller and has an inner diameter greater than the outer diameter of the connector 262. An adhesive 106, such as a plastic type adhesive, showing an elasticity after solidification is filled in clearances between the slitted outer peripheral portion of the connector 262 and between the closed end of the connector 262 and the end wall of the closed hole 101 so as to effect an elastic connection therebetween. On the other hand, a ring-like damping member 103 made of elastic rubber or plastic material is interposed between the unslitted outer peripheral portion of the connector 262 and the corresponding inner wall portion of the closed hole 101.

As will be apparent from FIGS. 15 and 17 a forward end portion 65a of the drive shaft 65 is reduced in diameter and has an external thread 64. A pair of parallel flat surfaces 104 are provided on the opposite surfaces of the forward end portion 65a over the substantially whole length thereof so as to be arranged symmetrical with respect to the axis of the drive shaft 65. A slit 105 is provided over the entire length of the forward end portion 65a to divide the portion 65a into two halves and it is passed through the center line of the above-mentioned two planes and the axis of the drive shaft 65. The external threaded portion 64 of the drive shaft 65 is engaged with an internally threaded portion 63 of the connector 262 to secure the impeller 58 to the drive shaft 65.

The embodiment as shown in FIGS. 12 to 15 will be proved very useful in treating a hot waste water. When the hot waste water is passed through the pump body, the impeller 58, connector 262 and external threaded portion 64 of the drive shaft 65 is heated owing to a hot waste water and thermally expanded. Since in this case the connector 262 is greater in thermal expansion coefficient than the ceramic impeller 58, if any protection is not provided against the thermal expansion, there is a fear that breakage will take place at the center shaft 56 of the impeller 58. As the connector 262 expands in the embodiment shown in FIGS. 15 to 18, the center shaft 56 of the impeller 58 is pushed inwardly through the adhesive 106 and the crossed slit 99 provided over the main portion of the connector 262 is narrowed by an amount corresponding to a difference in thermal expansion between the connector 262 and the ceramic impeller. An expansion occurring at the unslitted portion and its neighboring portion of the connector 262 causes the damping member 103 to be deformed. As a result, no crack and breakage of the impeller 58 by the thermal expansion of the connector 262 occurs, because few stress is applied to the center shaft 56 of the impeller 58. The forward end portion 65a of the drive shaft 65 which is in the connector 262 is also thermally expanded due to heat involved. Since the slit 105 can be narrowed, that thermal expansion of the forward end portion 65a which is normal to the slit 105 can be compensated. The thermal expansion of the forward end portion 65a, which is vertical to the axis of the externally threaded portion 64 and along the slit 105, is compensated by abutment of the longitudinal edges 65b of the flattened surface 104 against the internal thread 263 of the connector 262 and the consequent narrowing of the slit 105. The extent to which the slit clearance is narrowed is very small and is negligible. As a consequence, even when the forward end portion 65a of the drive shaft 65 is heated by a hot waste water, the thermal expansion of the forward end portion 65a is restricted. Furthermore, the presence of the flattened surfaces 104 obviates the necessity of providing more than one slit 105 for absorbing a thermal expansion. By doing so, the mechanical strength of the forward end portion 65a is not weakened with the attendant advantage.

What we claim is:

1. An impeller type pump including:

a front casing comprising a first ceramic main portion defining therein an inlet, one part of a pump chamber and one half of a discharge port, and a first protection member covering the first ceramic main portion;

a back casing confronting the front casing and comprising a second ceramic main portion defining therein the other part of the pump chamber and the other half of the discharge port, and a second protection member covering the second ceramic main portion;

a plurality of projections each having a flattened end surface, extending toward the second protection member and formed in spaced relation with each other on that marginal surface of the first protection member which confronts the second protection member;

a plurality of projections each having a flattened end surface, extending toward the first protection member and formed in spaced relation with each other on that marginal surface of the second protection member which confronts the first protection member, said projections of the second protection member being so arranged that the flattened end surfaces of the projections of the second protection member abut against the respective flattened end surfaces of the projections of the first protection member;

a continuous packing disposed between the marginal areas of the first and second ceramic main portions; and a plurality of overlapping, concentrical rims radially spaced from one another and integrally formed on those areas of the mutually confronting marginal surfaces of the first and second ceramic main portions which are adjacent to the pump chamber, said rims being so arranged that the rims of the first main portion form, with the rims of the second main portion, a narrow passage for decreasing the circumferential speed of waste water in said narrow passage from the circumferential speed of waste water in the pump body.

2. The impeller type pump according to claim 1, wherein said rims of the first and second main portions are loosely interdigitated to form a labyrinthine narrow passage.

* * * * *